US010508652B2

(12) United States Patent
Blass

(10) Patent No.: US 10,508,652 B2
(45) Date of Patent: Dec. 17, 2019

(54) AXIAL FAN FOR CONVEYING COOLING AIR, IN PARTICULAR FOR AN INTERNAL COMBUSTION ENGINE OF A MOTOR VEHICLE

(71) Applicant: MAHLE International GmbH, Stuttgart (DE)

(72) Inventor: Uwe Blass, Moeglingen (DE)

(73) Assignee: MAHLE International GmbH, Stuttgart (DE)

( * ) Notice: Subject to any disclaimer, the term of this patent is extended or adjusted under 35 U.S.C. 154(b) by 224 days.

(21) Appl. No.: 15/460,753

(22) Filed: Mar. 16, 2017

(65) Prior Publication Data

US 2017/0184112 A1 Jun. 29, 2017

Related U.S. Application Data

(63) Continuation of application No. PCT/EP2015/070701, filed on Sep. 10, 2015.

(30) Foreign Application Priority Data

Sep. 22, 2014 (DE) ..... 10 2014 219 023

(51) Int. Cl.

| | |
|---|---|
| ***F04D 19/00*** | (2006.01) |
| ***F04D 29/38*** | (2006.01) |
| ***F01D 5/14*** | (2006.01) |
| ***F04D 29/18*** | (2006.01) |
| *F04D 29/66* | (2006.01) |

(52) U.S. Cl.

CPC ..... *F04D 19/002* (2013.01); *F01D 5/141* (2013.01); *F04D 29/181* (2013.01); *F04D 29/384* (2013.01); *F04D 29/666* (2013.01); *F05D 2240/304* (2013.01)

(58) Field of Classification Search

CPC .... F04D 19/002; F04D 29/181; F04D 29/384; F04D 29/666; F01D 5/141

See application file for complete search history.

(56) References Cited

U.S. PATENT DOCUMENTS

| | | | | |
|---|---|---|---|---|
| 2,703,556 A * | 3/1955 | Doty, Jr. | ..... | F04D 29/384 415/222 |
| 3,937,189 A | 2/1976 | Beck | | |
| 4,329,946 A | 5/1982 | Longhouse | | |
| 4,505,641 A | 3/1985 | Tsuchikawa et al. | | |

(Continued)

FOREIGN PATENT DOCUMENTS

| | | |
|---|---|---|
| CN | 1873230 A | 12/2006 |
| CN | 101101006 A | 1/2008 |

(Continued)

*Primary Examiner* — Syed O Hasan

(74) *Attorney, Agent, or Firm* — Muncy, Geissler, Olds & Lowe, P.C.

(57) ABSTRACT

An axial fan for conveying cooling air, in particular for an internal combustion engine of a motor vehicle. The axial fan includes a hub, on which a plurality of fan blades extending radially outward is arranged, which each have a rear blade edge. In the case of an axial fan having an optimal relationship between efficiency and flow output, a contour of the rear blade edge of the fan blades extends curved in a circumferential direction with respect to a plane spanned by an axis of rotation of the axial fan and a longitudinal extent of the fan blade.

8 Claims, 2 Drawing Sheets

(56) References Cited

U.S. PATENT DOCUMENTS

| | | | | |
|---|---|---|---|---|
| 4,684,324 | A | 8/1987 | Perosino | |
| 4,768,472 | A | 9/1988 | Hayashi et al. | |
| 4,915,588 | A | 4/1990 | Brackett | |
| 5,193,608 | A * | 3/1993 | Sekine | B60K 11/08 123/41.49 |
| 5,244,347 | A | 9/1993 | Gallivan et al. | |
| 5,326,226 | A * | 7/1994 | Wyczalkowski | B01F 7/00341 29/889.3 |
| 5,393,199 | A | 2/1995 | Alizadeh | |
| 7,618,239 | B2 | 11/2009 | Hatsugai et al. | |
| 2013/0323072 | A1 | 12/2013 | Aschermann et al. | |

FOREIGN PATENT DOCUMENTS

| | | | |
|---|---|---|---|
| CN | 103270311 | A | 8/2013 |
| DE | 85 25 674 | U1 | 11/1985 |
| DE | 37 05 689 | A1 | 8/1987 |
| DE | 37 24 319 | A1 | 2/1989 |
| DE | 690 14 630 | T2 | 5/1995 |
| DE | 10 2010 062 301 | A1 | 6/2012 |
| EP | 0026997 | A1 | 4/1981 |
| EP | 0 536 662 | A1 | 4/1993 |
| EP | 0 583 091 | A2 | 2/1994 |
| JP | S51134906 | A | 11/1976 |
| JP | S5489304 | A | 7/1979 |

* cited by examiner

AXIAL FAN FOR CONVEYING COOLING AIR, IN PARTICULAR FOR AN INTERNAL COMBUSTION ENGINE OF A MOTOR VEHICLE

This nonprovisional application is a continuation of International Application No. PCT/EP2015/070701, which was filed on Sep. 10, 2015, and which claims priority to German Patent Application No. 10 2014 219 023.1, which was filed in Germany on Sep. 22, 2014, and which are both herein incorporated by reference.

BACKGROUND OF THE INVENTION

Field of the Invention

The invention relates to an axial fan for conveying cooling air, in particular for an internal combustion engine of a motor vehicle, comprising a hub, on which a plurality of fan blades, extending radially outward, is arranged, each of which have a trailing blade edge.

Description of the Background Art

DE 690 14 630 T2, which corresponds to U.S. Pat. No. 4,915,588, discloses an axial flow ring fan, which has a central hub, a ring-shaped shell, and a number of blades, whereby the blades extend radially between the hub and the shell. The blades, which will also be called fan blades hereinafter, are forwardly skewed in the direction of the fan rotation and have a leading edge and a trailing edge.

DE 10 2010 062 301 A1, which corresponds to US 2013/0323072, which is incorporated herein by reference, and which discloses an axial fan, which comprises a hub, on which a pressure side and a suction side, a trailing edge, and fan blades having a blade depth are arranged. Moreover, said axial fan on the pressure side of the fan blades has a hub ramp, which is inclined upwardly counter to the direction of rotation of the axial fan, as a result of which the trailing edge of the fan blades is divided into an outer region situated radially outside the hub ramp and an inner region situated radially within the hub ramp. Recesses or cutouts are present within the hub ramp to reduce the weight of the axial fan.

SUMMARY OF THE INVENTION

It is therefore an object of the invention to increase the efficiency of an axial fan of this kind while retaining the flow output.

An exemplary embodiment of the invention relates to an axial fan for conveying cooling air, in particular for an internal combustion engine of a motor vehicle, comprising a hub, on which a plurality of fan blades, extending radially outward, is arranged, each of which have a trailing blade edge. In the case of an axial fan of this kind, a contour of the trailing blade edge of the fan blades extends curved in the circumferential direction in a plane, spanned by an axis of rotation of the fan and a longitudinal extent of the fan blade. This has the advantage that the efficiency of the axial fan is increased, whereby the flow output of the axial fan is maintained.

Advantageously the contour of the trailing blade edge extends in its radial extent in three sections, whereby the middle section can be formed substantially straight or approximately straight, whereas the first and third sections, each joining the middle section, can extend in a curved manner. Because of the semi-radial flow through the fan blade under the given conditions, a very good compromise results between flow outputs and static efficiency.

In an embodiment, the first outer section of the trailing blade edge, the section facing away from the hub, is curved with a first radius and the third section of the trailing blade edge, said section joining the hub, is curved with a second radius. This can be seen especially clearly if the contour is projected in a plane, which is spanned by the axis of rotation of the radial fan and the radial extent of the fan blade, if it is intersected by the axial fan rotation profile.

In an embodiment, the second radius of the third section and/or the first radius of the first section of the trailing blade edge transition tangentially into the straight middle section of the contour of the trailing blade edge. This positively influences the conducting of the flow in the area of the trailing blade edge. The trailing blade edge in the area of predominant flow losses is adjusted so that both a good pressure build-up and also a good efficiency can be achieved.

In an embodiment, a first ratio of the first radius of the first section of the trailing blade edge contour to the entire radial extent of the fan blade is between 0.8 and 1.2. This optimizes still further the efficiency of the axial fan.

In an embodiment, a second ratio between the first radius of the first section and the second radius of the third section of the trailing blade edge contour is between 3 and 4.

In an embodiment, the second and third sections of the trailing blade edge contour extend over approximately a fourth of the radial extent of the fan blade, as a result of which the efficiency of the axial fan is increased further.

Moreover, a further embodiment allows that the first section of the trailing blade edge contour, said section facing away from the hub, extends over approximately half of the radial extent of the fan blade. This embodiment as well supports the establishment of an optimal relationship between the efficiency and flow output of the axial fan.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figures 1, 2, 3:
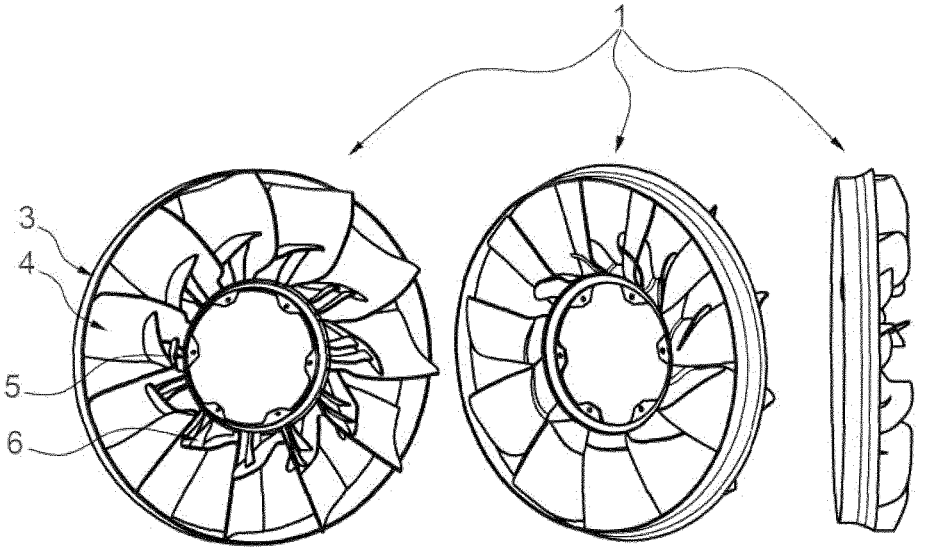
FIG. 1 shows an exemplary embodiment of the axial fan of the invention in a perspective front view.
FIG. 2 shows an exemplary embodiment of the axial fan of the invention in a perspective back view.
FIG. 3 shows the exemplary embodiment of the axial fan of the invention in a side view.

FIGS. 1, 2, and 3 show an exemplary embodiment of an axial fan 1 of the invention. Axial fan 1 has a central hub 2 and a ring-shaped shell 3 between which a plurality of fan blades 4 is arranged. A hub ramp 5, which is inclined upwardly in each case counter to the rotation direction of axial fan 1 and is attached via bar 6 on the fan blade, is arranged on the pressure side of fan blades 4.

Figure 4:
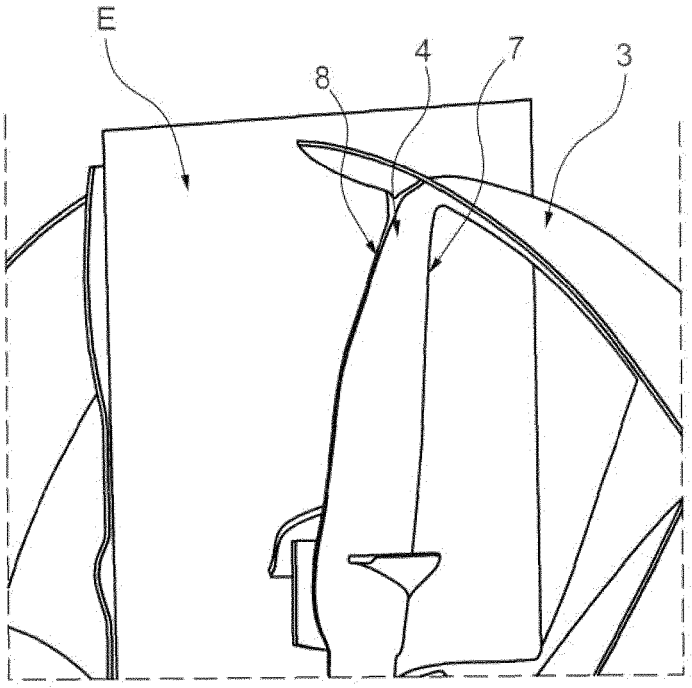
FIG. 4 shows a detail from a front view of the exemplary embodiment of the axial fan of the invention.

Each fan blade 4 in this case has a leading blade edge 7, disposed below in the rotation direction, and a top trailing blade edge 8. Contour 9 of trailing blade edge 8 of fan blade 4 is clarified in FIG. 4, where a plane E is spanned by the axis of rotation of axial fan 1 and the radial extent H of fan blade 4. If this plane E is cut by the rotation profile of axial fan 1, a contour 9 of trailing blade edge 8 of fan blade 4 results, which is divided into three sections.

Figure 5:
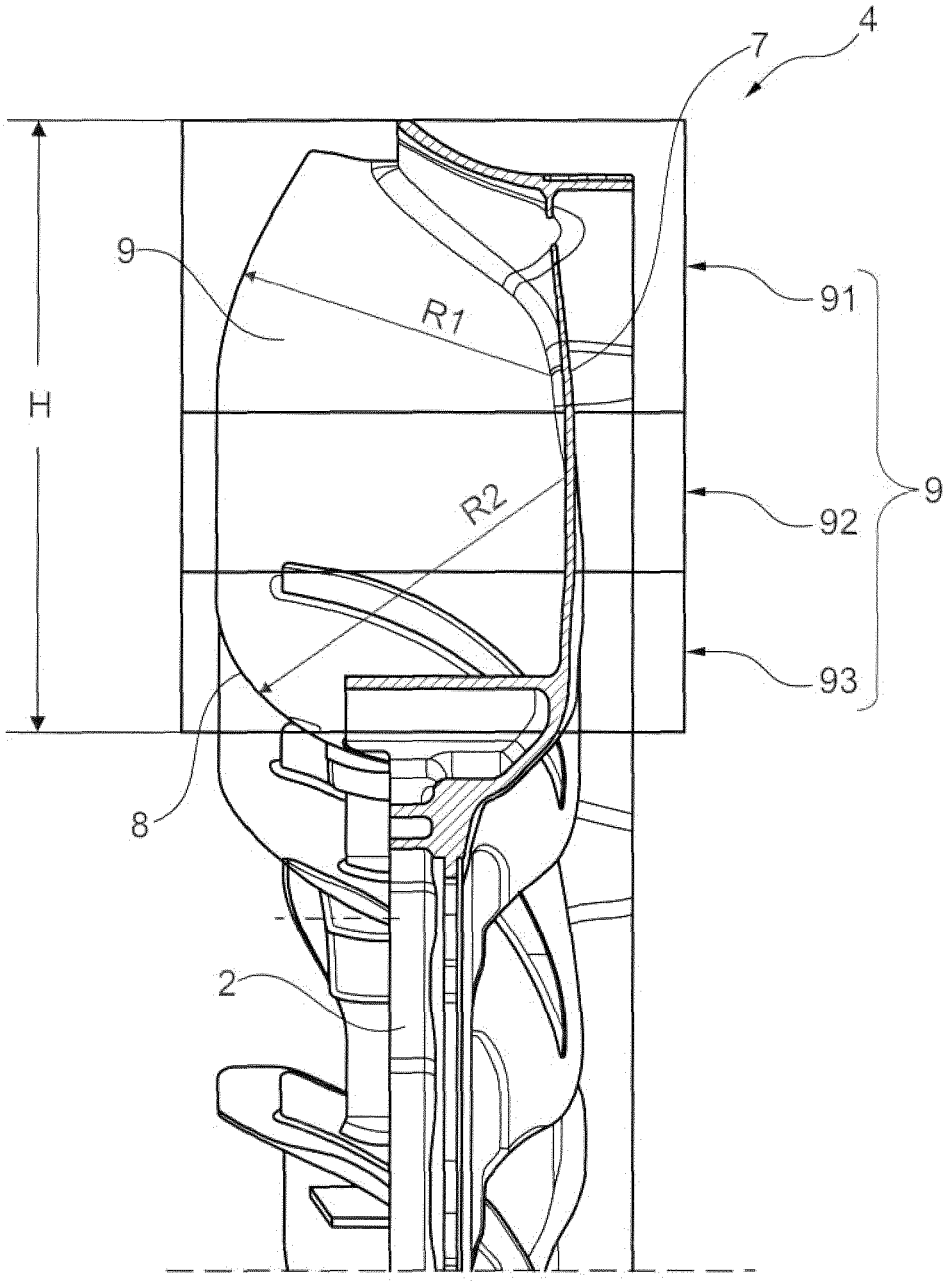
FIG. 5 shows a schematic illustration of a fan blade of the exemplary embodiment according to FIG. 1.

As is evident from FIG. 5, a first outer section 91 of contour 9 of trailing blade edge 8 is formed curved and described by a first radius R1. A straight middle section 92 of contour 9 of trailing blade edge 8 joins said radius R1. Straight section 92 joins a third inner section 93 of contour 9 of trailing blade edge 8, which adjoins hub 2 directly. Contour 9 in third section 93 of trailing blade edge 8 is formed curved and can be described by a second radius R2. The middle and third sections 92, 93 of contour 9 of trailing blade edge 8 in this case extend over approximately a fourth of the radial extent H of fan blade 4. The first outer section 91, facing away from hub 2, of contour 9 of trailing blade edge 8 extends approximately into the outer half of the radial extent H of the fan blade. At straight middle section 92 of trailing blade edge 8, the curved first or curved third section 91, 93 joins the straight line tangentially.

To establish an optimal ratio between the flow output and the static efficiency of axial fan 1, a first ratio of radius R1 of first outer section 91 of contour 9 of trailing blade edge 8 and the radial extent H of fan blade 4 between 0.8 and 1.2 is to be selected. This optimization is supported, if the ratio between first radius R1 of first section 91 and second radius R2 of third section 93 moves in the range between 3 and 4.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An axial fan for conveying cooling air for an internal combustion engine of a motor vehicle, the axial fan comprising:

a hub; and a plurality of fan blades arranged on the hub, the plurality of fan blades extending radially outward, and each of which has a trailing blade edge, a contour of the trailing blade edge of the fan blades extending curved in a circumferential direction with respect to a plane spanned by an axis of rotation of the axial fan and a longitudinal extent of the fan blade, wherein in a radial extent of the trailing blade edge, the contour of the trailing blade edge is divided into a first, second, and third section, wherein the second section is a middle section that is substantially straight, and the first and third sections are each curved sections and each join respective ends of the second section, the first section being an outer section facing away from the hub and the third section being an inner section joining the hub, and wherein the first section extends over a greater portion of a radial extent of the fan blade than the second section and the third section.

2. The axial fan according to claim 1, wherein the first section of the trailing blade edge is curved with a first radius and wherein the third section of the trailing blade edge is curved with a second radius.

3. The axial fan according to claim 2, wherein the second radius of the third section and/or the first radius of the first section of the trailing blade edge transition tangentially into the second section.

4. The axial fan according to claim 2, wherein a first ratio of the first radius of the first section of the contour of the trailing blade edge to the radial extent of the fan blade is between 0.8 and 1.2.

5. The axial fan according to claim 4, wherein a second ratio between the first radius of the first section and the second radius of the third section of the contour of the trailing blade edge is between 3 and 4.

6. The axial fan according to claim 1, wherein the second and third sections of the contour of the trailing blade edge extend over approximately a fourth of the radial extent of the fan blade.

7. The axial fan according to claim 1, wherein the first section of the contour of the trailing blade edge extends over approximately half of the radial extent of the fan blade.

8. The axial fan according to claim 1, wherein the third section includes a curved protrusion extending perpendicularly therefrom, the curved protrusion being curved in a direction towards the hub.

* * * * *